US010071871B2

(12) United States Patent
Hunter et al.

(10) Patent No.: US 10,071,871 B2
(45) Date of Patent: Sep. 11, 2018

(54) AIR KNIFE CONFIGURED TO IMPROVE ROLLING OF PAPER PRODUCT

(71) Applicant: GPCP IP Holdings LLC, Atlanta, GA (US)

(72) Inventors: Mark S. Hunter, Green Bay, WI (US); David S. Veldhuizen, Green Bay, WI (US); Thomas K. Toothman, Peachtree City, GA (US); Lawrence J. Fuchs, Denmark, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 279 days.

(21) Appl. No.: 14/173,431

(22) Filed: Feb. 5, 2014

(65) Prior Publication Data

US 2014/0263804 A1 Sep. 18, 2014

Related U.S. Application Data

(60) Provisional application No. 61/782,756, filed on Mar. 14, 2013.

(51) Int. Cl.
*B65H 18/26* (2006.01)
*B65H 23/00* (2006.01)

(52) U.S. Cl.
CPC ..... *B65H 18/26* (2013.01); *B65H 23/00* (2013.01); *B65H 2301/331* (2013.01); *B65H 2301/4148* (2013.01); *B65H 2301/41432* (2013.01); *B65H 2406/1222* (2013.01); *B65H 2406/364* (2013.01); *B65H 2511/212* (2013.01); *B65H 2801/84* (2013.01)

(58) Field of Classification Search
CPC ..... B65H 18/26; B65H 2301/4148; B65H 2406/1222; B65H 2801/84
USPC ..... 242/532.2
See application file for complete search history.

(56) References Cited

U.S. PATENT DOCUMENTS 2,896,710 A * 7/1959 Wells ..... D21F 2/00 162/371
3,355,349 A * 11/1967 Devlin ..... D21F 7/04 100/173
3,869,095 A * 3/1975 Diltz ..... B65H 19/2246 242/521
4,050,642 A 9/1977 Katsumata et al.
(Continued)

FOREIGN PATENT DOCUMENTS

JP H05170238 7/1993
SU 323492 A1 11/1972
(Continued)

OTHER PUBLICATIONS

International Preliminary Report on Patentability (Chapter 1) that issued in PCT/US2014/017639 dated Sep. 15, 2015.
(Continued)

*Primary Examiner* — Michael E Gallion

(57) ABSTRACT

Described herein are methods and systems for minimizing folding defects when rolling a paper product. The method comprises rotating a roll in a manner that draws a paper product toward the roll. The location of a pick-up point between the roll and the paper product is altered by influencing the air pressure experienced by the paper product. This may be accomplished by flowing air in one of several manners described in the specification.

21 Claims, 5 Drawing Sheets

(56) References Cited

U.S. PATENT DOCUMENTS 4,501,643 A * 2/1985 Kiuru ..... B26F 3/02 162/193
4,543,160 A * 9/1985 Kerttula ..... D21G 9/0063 162/193
4,648,942 A * 3/1987 Wanke ..... D21G 9/0063 162/193
4,692,215 A * 9/1987 Kerttula ..... D21G 9/0072 162/193
4,904,344 A * 2/1990 Peiffer ..... D21G 9/0072 162/193
5,234,549 A * 8/1993 Weldon ..... D21G 9/0072 162/193
5,328,136 A * 7/1994 Muller ..... B65H 19/28 226/97.1
5,354,007 A * 10/1994 Fissmann ..... B65H 20/14 242/532.7
5,503,716 A * 4/1996 Kivimaa ..... D21G 9/0063 162/193
6,073,825 A * 6/2000 Hilker ..... D21G 9/0063 162/193
6,395,135 B1 * 5/2002 Kojo ..... B65H 23/04 162/193
6,454,903 B2 * 9/2002 Mohrsen ..... D21G 9/0063 162/193
6,524,388 B1 2/2003 Yamada et al.
6,557,269 B1 5/2003 Schuler et al.
6,581,868 B1 6/2003 Enwald et al.
RE39,601 E 5/2007 Svanqvist et al.
8,119,055 B2 * 2/2012 Pellengo Gatti ..... B65H 18/00 242/417
8,177,940 B2 5/2012 Kramer et al.
8,192,582 B2 * 6/2012 Chamberland ..... B65H 20/14 162/202
2004/0245367 A1 12/2004 Malard et al.
2008/0073402 A1 * 3/2008 Hikita ..... B29C 47/0021 226/196.1
2013/0026280 A1 * 1/2013 Li ..... B65H 19/2276 242/535.1
2013/0056574 A1 * 3/2013 Li ..... B65H 19/2276 242/541.2
2013/0119182 A1 * 5/2013 Higeta ..... B65H 18/145 242/538.1

FOREIGN PATENT DOCUMENTS

SU 1263203 A3 10/1986
WO WO 03/004389 1/2003
WO WO 2011/076268 6/2011

OTHER PUBLICATIONS

International Search Report and Written Opinion of the International Searching Authority that issued in PCT/US2014/017639 dated May 29, 2014.
English language Abstract of JPH05170238, published Jul. 9, 1993.

* cited by examiner

AIR KNIFE CONFIGURED TO IMPROVE ROLLING OF PAPER PRODUCT

CROSS REFERENCE TO RELATED APPLICATION

This application claims the benefit of priority from U.S. Provisional Patent Application No. 61/782,756, filed Mar. 14, 2013, which is incorporated herein by reference in its entirety.

The present disclosure relates to paper manufacturing and processing. In particular, the present disclosure relates to methods and systems for reducing folding defects and improving the wrap of a paper product as it is rolled.

During paper manufacturing and processing, a paper web or sheet is typically wound onto a large roll at least once. The rolling process involves continuously and repeatedly turning a large roll about a central shaft, drawing the paper sheet onto the roll as the sheet leaves another component of the paper machine. For example, the rolling process may occur as the web exits a drying section of the paper machine, or as the sheet(s) exits a slitter.

Paper manufacturing and processing typically involves moving the paper product at very high speeds. Because of these high speeds, a number of rolling defects may occur. For example, the paper product may experience wrinkles, folds, curling, edge flutter, and the like. Certain paper processing methods—such as cutting the sheet with a slitter—increase the likelihood of rolling defects, particularly along the edges of the sheet.

In light of the potential for rolling defects, one objective during the manufacture and processing of a paper product is sheet handling or sheet control. Various methods have been employed in order to control a paper web. For example, different types of sheet stabilizers have been used. Some sheet stabilizers simply provide a surface against which a sheet may ride. Some stabilizers use direct sheet contact, while other stabilizers do not directly contact the sheet but come close to contacting it as it runs along the stabilizer. Other stabilizers use an airfoil design to alter the boundary layer of air that runs alongside the moving sheet. Some stabilizers provide air flow between the stabilizer and the sheet in order to directly change or replace the boundary layer between those two surfaces.

However, the methods described above are not ideal in that they are typically expensive, difficult to calibrate and adjust, and are not as effective at higher speeds. They also require placing components in close proximity with the sheet, which is not always desirable. For example, placing components in close proximity with the sheet may prevent the use of certain non-circular rolls, such as bowed rolls, because these rolls may alter the position of the sheet as the rolls rotate.

Accordingly, a need exists for an improved method of reducing roll defects in the papermaking process that does not suffer from the downsides discussed above.

SUMMARY OF THE DISCLOSURE

In accordance with certain embodiments of the present disclosure, various methods, devices, and systems are described for reducing folding defects and improving the wrap of a paper product as it is rolled. According to one exemplary embodiment, a method of receiving a paper product on a roll is described. In one aspect, the method comprises rotating the roll in a manner that draws the paper product toward the roll. In another aspect, the method includes altering the location of a pick-up point between the roll and the paper product by influencing the air pressure experienced by the paper product.

According to another exemplary embodiment, a method for rolling a paper product without creating roll defects is provided. In one aspect, the method comprises suspending the paper product between a roll and a papermaking component. In another aspect, the method comprises applying a pressure difference to a portion of the suspended paper product by flowing air in a direction that causes the portion to move toward the roll. In another aspect, the method comprises rolling the paper product.

In another exemplary embodiment, a paper-product rolling apparatus is described. In one aspect, the paper-product rolling apparatus comprises a web and a roll configured to receive the web. In another aspect, paper-product rolling apparatus comprises an air knife configured to direct gas away from a portion of the web that is not yet in contact with the roll, whereby the gas causes the portion of the web to move toward the roll.

According to another exemplary embodiment, an air-knife system for moving air in a direction away from a paper product during a rolling process is provided. In one aspect, the air-knife system comprises a source of compressed air, a hose for transferring the compressed air, a nozzle configured to direct air away from the paper product, and a frame supporting at least the nozzle. In another aspect, the air-knife system comprises a roll configured to receive the paper product. In yet another aspect, the air-knife system comprises a first plane defined by a portion of the paper product not yet in contact with the roll. In another aspect, the air-knife system comprises a second plane, parallel to the first plane, which intersects the rotational axis of the roll. In yet another aspect, the nozzle is configured to direct air away from the portion of the paper product such that the air travels through the second plane.

Additional advantages of the described methods, devices, and systems will be set forth in part in the description which follows, and in part will be obvious from the description, or may be learned by practice of the disclosure. The advantages of the disclosure will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments and together with the description, serve to explain the principles of the disclosure.

DESCRIPTION

Reference will now be made in detail to certain exemplary embodiments, examples of which are illustrated in the accompanying drawings. Wherever possible, the same reference numbers will be used throughout the drawings to refer to the same or like items.

Figure 1:
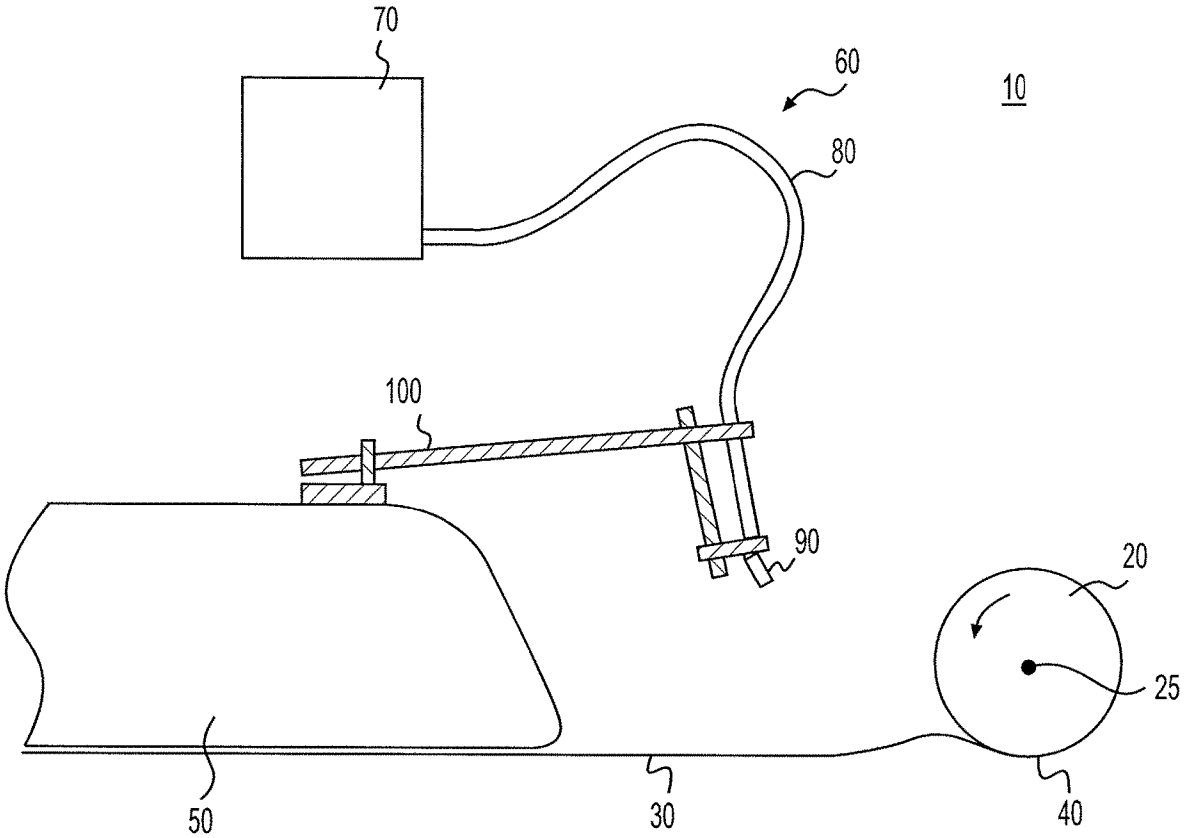
FIG. 1 is a side view of an exemplary embodiment of a paper-rolling apparatus as disclosed herein.

FIG. 1 depicts one embodiment of a paper-product rolling apparatus 10. Paper-product rolling apparatus 10 depicts only a part of the overall process of making and processing paper, and may include other steps, processes, or machinery that is not shown in FIG. 1. Paper-product rolling apparatus 10 includes an exemplary roll 20 for receiving a paper product 30 and rolling paper product 30 onto roll 20. Roll 20 is depicted in FIG. 1 as having a substantially circular profile when viewed from the side. However, roll 20 may use a different shape. For example, roll 20 may have an oval profile, known in the industry as a "bowed roll." Roll 20 may take on any other shape that allows for the uptake of paper product 30. Roll 20 rotates around a rotational axis 25. In FIG. 1, roll 20 is shown to be rotating counterclockwise about rotational axis 25. Of course, roll 20 may also be configured to rotate clockwise about rotational axis 25.

FIG. 1 also shows paper product 30 coming into contact with roll 20 at a pick-up point 40. Pick-up point 40 is the location at which paper product 30 first contacts roll 20. This point may also be referred to as a contact point, take-up point, and the like. Pick-up point 40 may be altered by methods discussed later in this disclosure.

In FIG. 1, paper product 30 is shown having exited a component 50. Component 50 may be any component used in making or processing paper. In FIG. 1, component 50 is depicted as an active air foil, designed to control the flow of air in the vicinity of paper product 30 while paper product 30 is in proximity to component 50. In some embodiments, component 50 may include a slitter designed to cut paper product 30 into at least two sheets. A slitter may cut paper product 30 mechanically, via sharp metal edges, for example, or it may operate hydraulically, cutting paper product 30 via a high-pressure jet of liquid. Component 50 may comprise any component in a papermaking process that precedes the rolling of the paper product 30 onto a roll structure 20. For example, component 50 may comprises a roll, a drier, a transport web, and so on.

A portion of paper product 30 spans the distance between component 50 and roll 20. This portion of paper product 30 may be suspended between the two components, maintaining a general position based primarily on the tension created by the rotation of roll 20. The precise position of paper product 30 may also be influenced by other factors, as discussed further below.

A person of ordinary skill in the art will appreciate that cutting a paper sheet increases the potential for folding defects. This may be true for a number of different reasons. For example, cutting a sheet increases the number of sheet edges to be controlled. While a single sheet has two sheet edges, cutting that sheet in the machine direction would, for example, double the number of sheet edges to four. Sheet edges are typically more susceptible to folding defects. For example, if the tension is too loose on the edges, the edges may experience edge flutter. Edge flutter may cause the sheet to not lay flat on the roll, or may cause the edges to wrinkle or fold as they contact the roll. Sheet edges that are in close proximity to one another—for example, two edges created by cutting a sheet in the machine direction—present an additional challenge. As these edges are rolled onto a roll, they may overlap to some degree. This prevents the roll from later being separated into two smaller rolls, as the intertwined edges hold the two smaller rolls together. Proper sheet control may help avoid these types of folding defects.

In an embodiment of the invention, an air knife 60 may be used to prevent folding defects and improve wrap of paper product 30 onto roll 20. Air knife 60 may take on a number of different forms, but one exemplary purpose of air knife 60 is to disperse compressed air in a particular direction. As shown in the exemplary embodiment of FIG. 1, air knife 60 comprises a compressed air source 70, an air hose 80, a nozzle 90, and a frame 100. In this context, the phrase "air knife" does not only correspond to devices on the market referred to as an "air knife"; but the phrase also include other structures that corresponds to the structure as described herein or perform the same function as the structure described herein. Moreover, air knife 60 need not use air. Air knife 60 may use any type of fluid suitable for accomplishing the goals described herein. For example, other forms of gas may suitably be used. For simplicity, however, the use of air will be described.

Compressed air source 70 may comprise any source of compressed air, such as a pressurized tank of air or simply an air compressor. Air hose 80 is connected to compressed air source 70. Air hose 80 may be connected via a valve that can control the flow of compressed air though air hose 80. Air hose 80 may be constructed from stainless steel or other art recognized material suitable for handling the force of the compressed air. Air hose 80 may be a hard line, a flexible tube, or a combination of both.

Air hose 80 is connected to nozzle 90. Nozzle 90 may be configured to direct compressed air in one or more directions. Nozzle 90 may comprise a single outlet through which air flows, or it may comprise a plurality of outlets. For example, nozzle 90 may comprise a plurality of small holes arranged in a line, or some other shape or arrangement. In another embodiment, nozzle 90 may comprise a long, thin slot through which air flows. In situations where air knife 60 is used in conjunction with a wide sheet of paper, nozzle 90 may extend across at least the majority of the width of the paper in the cross-machine direction. Nozzle 90 may be directed in one or more directions at the same time, and may be easily adjustable by the user. For example, air pressure and velocity may be controlled by a valve at nozzle 90 or at compressed air source 70, or both.

Nozzle 90 and air hose 80 are secured in place via a frame 100. Frame 100 may be attached to any stationary object in the vicinity of paper-product rolling apparatus 10. In the exemplary embodiment of FIG. 1, frame 100 is shown attached to component 50. Frame 100 may be constructed from a strong material such as metal, plastic, composite, or the like. Frame 100 may include a plurality of adjustability points, allowing a user to adjust the length and angles of the various arms of frame 100. For example, a user may rotate certain portions of frame 100 about pivot points, and/or slide certain portions of frame 100 relative to other portions of frame 100. In addition, the orientation of nozzle 90 may be adjusted in conjunction with frame 100. For example, a clamp may be adjusted such that nozzle 90 can be pointed in any direction.

Figure 2:
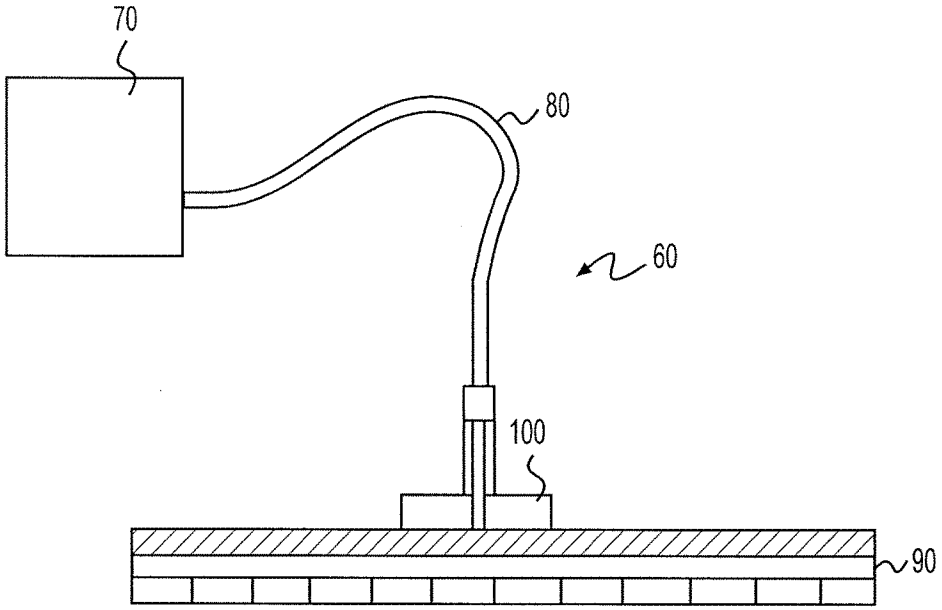
FIG. 2 is a front view of an exemplary embodiment of an air knife as disclosed herein.

FIG. 2 depicts an exemplary embodiment of air knife 60 as viewed from the front—in other words, looking toward air knife 60 along a line of sight in the machine direction. As in FIG. 1, FIG. 2 depicts air knife 60 as including compressed air source 70, air hose 80, nozzle 90, and frame 100. In this particular embodiment, nozzle 90 stretches across the cross-machine direction. In some embodiments, nozzle 90 is configured to be approximately as wide as paper product 30. Nozzle 90 need not be oriented in the cross-machine direction, however. For example, nozzle 90 may be oriented at an angle such that one end of nozzle 90 is further upstream, in the machine direction, relative to the other end of nozzle 90. Similarly, one end of nozzle 90 may be oriented further from paper product 30, in a vertical direction, relative to the other end.

While nozzle 90 is shown in FIG. 2 as a single unit, nozzle 90 may comprise a plurality of nozzles. For example, frame 100 may be configured such that it accepts any number of individual nozzles. In such an embodiment, each individual nozzle of nozzle 90 may be configured to point in one or more directions independent of one another.

Figure 3A:
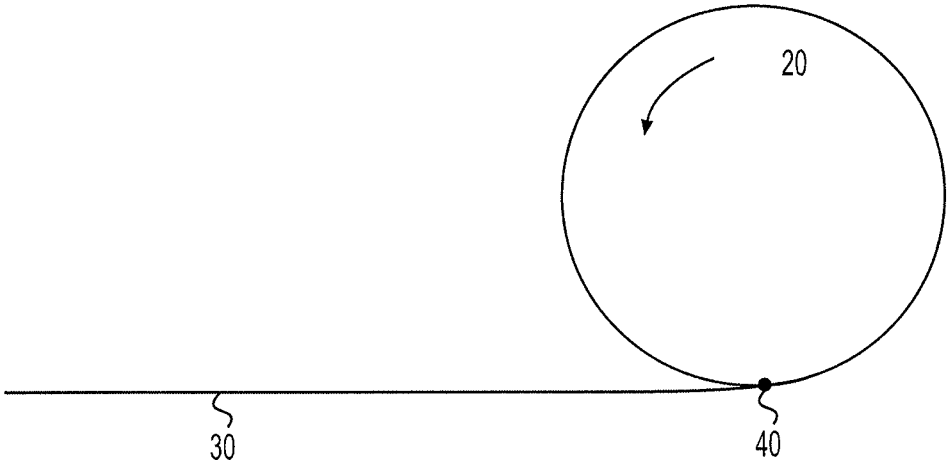
FIG. 3A is a side view of an exemplary embodiment of a roll and a paper product without the use of an air knife.
Figure 3B:
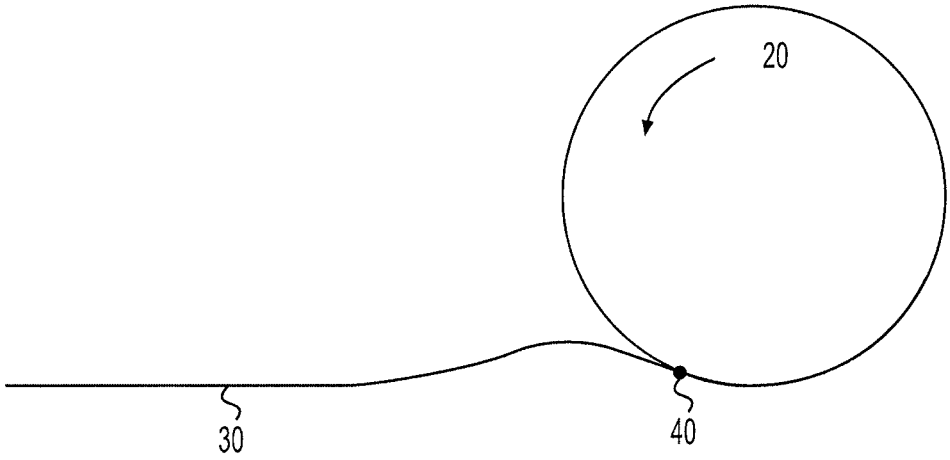
FIG. 3B is a side view of an exemplary embodiment of a roll and a paper product influenced by an air knife as disclosed herein.

Referring now to FIGS. 3A and 3B, Applicants have discovered that air knife 60 (shown in FIGS. 1 and 2) may be used to gain control over the behavior of paper product 30 as it is transported between component 50 and roll 20. Controlling the behavior of paper product 30 results in fewer folding defects and may lead to more precise rolling, higher machine speeds, and increased reliability. In some embodiments, increased control over paper product 30 results in altering the location of pick-up point 40. FIG. 3A shows a typical pick-up point 40, where paper product 30 first contacts roll 20, in the absence of any influence from air knife 60. The precise location of pick-up point 40 is not drawn to scale and is merely provided for reference, particularly with respect to FIG. 3B. FIG. 3B depicts roll 20 and paper product 30 contacting one another at a pick-up point 40 that differs in location from the pick-up point 40 of FIG. 3A. FIG. 3B is intended to demonstrate the influence of air knife 60 on the behavior of the sheet. Although exaggerated for the purpose of demonstration, and not to scale, FIG. 3B illustrates that air knife 60 may be used to bias paper product 30 closer to roll 20, resulting in earlier contact with roll 20. As used in this context, the word "bias" is intended to indicate exerting some influence. As a result, air knife 60 may bias paper product 30 without actually moving paper product 30 to the extent illustrated by FIG. 3B.

Figure 4A:
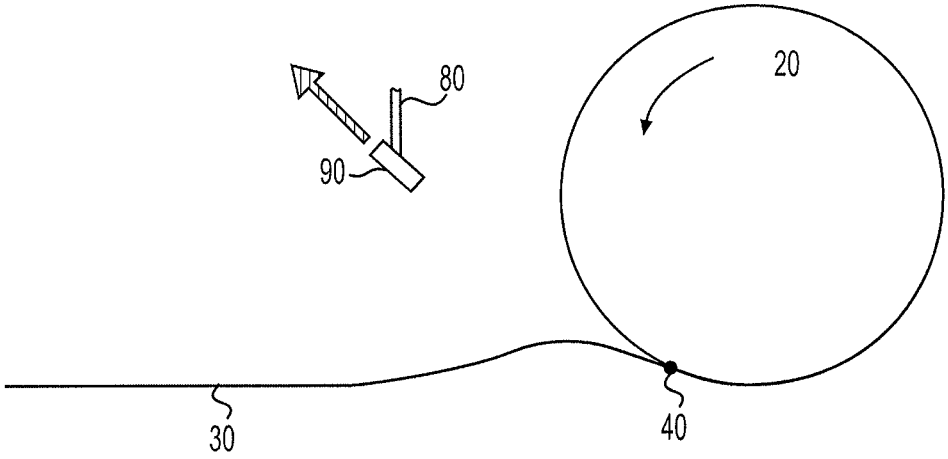
FIG. 4A is a side view of an exemplary embodiment of a roll, paper product, and air knife as disclosed herein.
Figure 4B:
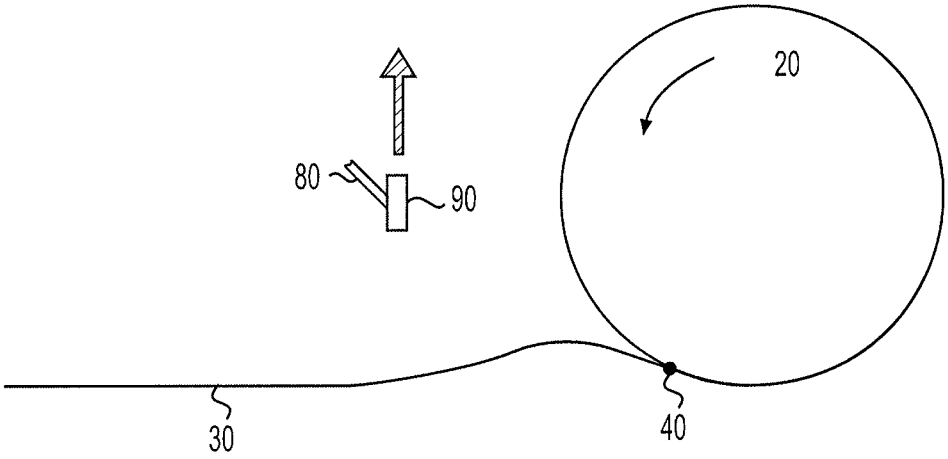
FIG. 4B is a side view of an exemplary embodiment of a roll, paper product, and air knife as disclosed herein.
Figure 4C:
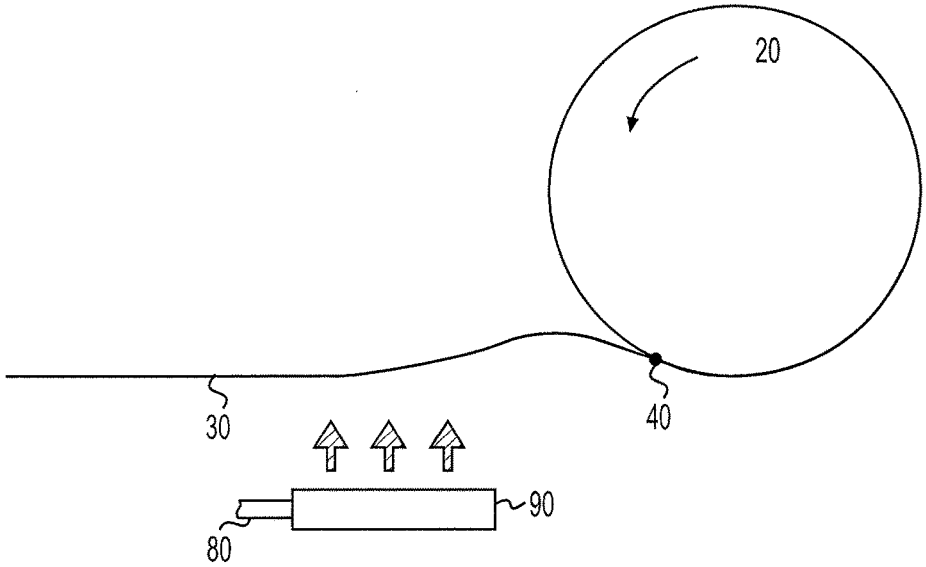
FIG. 4C is a side view of an exemplary embodiment of a paper-rolling apparatus as disclosed herein.

While the differences between FIGS. 3A and 3B illustrate an exemplary result of using air knife 60, FIGS. 4A-4C each show an exemplary embodiment illustrating how air knife 60 (FIGS. 1 and 2) may be applied. For example, FIGS. 4A-4C each illustrate a portion of air knife 60 that includes air hose 80 and nozzle 90. The additional components of air knife 60 described above are omitted from the figures, but it is understood that all of those components may be used in conjunction with the air hose 80 and nozzle 90 of FIGS. 4A-4C.

FIG. 4A depicts a side view of air hose 80 and nozzle 90 positioned relative to paper product 30 and roll 20. In this exemplary embodiment, nozzle 90 is directed away from paper product 30 at an angle, in the direction indicated by the arrow extending away from nozzle 90. Applicants have discovered that control over paper product 30 is possible by directing a fluid, such as air, away from paper product 30. Directing fluid away from paper product 30 induces a lower pressure on the top side of paper product 30 relative to the bottom side, as viewed from the side view of FIG. 4A. This lower pressure may have a desirable effect of increasing tension in paper product 30 such that folding defects are minimized. The lower pressure may also bias paper product 30 toward the roll so that pick-up point 40 is altered in a favorable manner, as described in conjunction with FIG. 3B.

FIG. 4B depicts a side view of an exemplary embodiment wherein nozzle 90 is oriented to blow in a direction that is perpendicular (i.e. orthogonal) to paper product 30. FIGS. 4A and 4B illustrate that the same result—that is, biasing paper product 30 toward roll 20—may be accomplished by orienting nozzle 90 in a number of different directions. The desired effects of the low pressure zone may be controlled by nozzle 90, including the direction of nozzle 90, the volume and velocity of air flowed from nozzle 90, and the distance from paper product 30 and roll 20 that nozzle 90 is located.

As shown in FIGS. 4A and 4B, nozzle 90 need not be placed in particularly close proximity to paper product 30. Indeed, one advantage of air knife 60, as disclosed, is that it may be used to influence paper product 30 from a greater distance relative to traditional methods. For example, some traditional methods require stabilizers or air foils that are located close enough to the paper product such that they are in contact with the air boundary resulting from the movement of the paper product. Such methods are complex, more difficult to calibrate, and inflexible. For example, an air foil or stabilizer would not work in a situation where a bowed roll is used to receive the paper product. As a bowed roll rotates, the incoming sheet of paper product is shifted up and down as the sheet alternatively contacts the wider and narrower diameters of the roll. As the paper product shifted away from an air foil or stabilizer, it would lose any beneficial effects of the air foil or stabilizer.

The negative side effects of traditional methods are avoided by the air knife 60 as disclosed herein. By altering the pressure in the general area on one side of paper product 30, the behavior of paper product 30 may be influenced uniformly even as paper product 30 changes orientations. This allows for the use of a bowed roll while still minimizing folding defects. Another advantage of the disclosed air knife system is that, by flowing air away from the sheet, more delicate control becomes possible. A strong stream of air directed toward a sheet may cause rips or tears, or may require very careful calibration. The setups illustrated by FIGS. 4A and 4B avoid this downside while still providing the necessary control over paper product 30. Another advantage of the embodiments shown in FIGS. 4A and 4B is that the air flow may be used to exhaust unwanted debris and/or hot air away from the system.

The concept of increasing the pressure experienced by the sheet of paper product without directly blocking or replacing the air boundary running along the sheet is also illustrated in the embodiment of FIG. 4C. FIG. 4C is a side view of an exemplary embodiment wherein nozzle 90 is located underneath paper product 30 and flows toward paper product 30. Air hose 80 feeds air to nozzle 90. FIG. 4C is not drawn to scale; nozzle 90 is intended to be located a distance away from paper product 30 so as to affect the overall pressure experienced by that side of the sheet. When flowing a fluid toward paper product 30, rather than away from it, it may be advantageous to use low velocity air flow so as to not rip or disturb paper product 30. This may be accomplished by increasing the number or area of nozzles used, as well as carefully controlling the distance between the nozzles and paper product 30. The pressure change caused by the fluid flow from nozzle 90 may bias paper product 30 toward roll 20 so that pick-up point 40 is altered in a favorable manner.

With respect to air flow used, for example, in the embodiments depicted by FIGS. 4A-4C, Applicants have discovered that a number of parameters may be modified to achieve the desired air flow, pressure differential and ultimately, sheet stability and pick-up point. Parameters include number of nozzles, nozzle size, nozzle placement, nozzle direction, velocity of air, and volume of air. For example, one such parameter is the velocity of the air exiting nozzle 90. A higher velocity will cause a larger change in air pressure experienced by paper product 30. Another parameter is the volume of air exiting nozzle 90. For example, when comparing a nozzle with a large opening to a nozzle with a small opening, the nozzle with the large opening will be able to achieve a particular pressure using lower velocity air. Likewise, in an exemplary embodiment, the volume of air evacuated from an area near pick-up point 40 to achieve the desired pressure difference is based on the volume of air flow generated by various upstream components—for example, a high-pressure water slitter, catcher tube components, and so on—as well as the boundary layer created by the sheet and/or air foils. According to one embodiment, the volume of air that is evacuated from the area near pick-up point 40 is used as the primary factor to control the system parameters.

Based on the information provided herein and that available in the art, one of ordinary skill in the art would understand how to modify the system parameters, including the velocity, volume, direction of nozzle 90, etc., to achieve the desired pressure change. Optimizing the system by balancing the air flows and pressure changes caused by all aspects of the papermaking system would also be within the current skill of the artisan.

Figure 5:
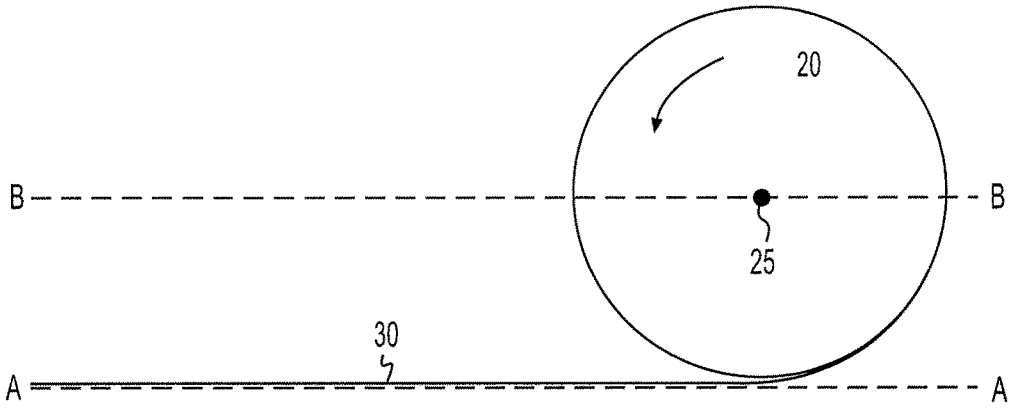
FIG. 5 is a side view of an exemplary embodiment of a roll and a paper product, showing two parallel planes as disclosed herein.

FIG. 5 is a side view of an exemplary embodiment of a roll 20 and a paper product 30, illustrating two parallel planes. The first plane, A-A, runs along the portion of paper product 30 spanning the area between component 50 (not shown) and roll 20. While, in practice, this portion of paper product 30 may not be perfectly straight and flat, plane A-A is oriented such that it is concurrent with the largest proportion of paper product 30 possible. Plane B-B is parallel to plane A-A, and intersects the rotational axis 25 of roll 20. A third plane, C-C (not shown), may be considered as parallel to planes A-A and B-B, located on the opposite side of A-A at the same distance from A-A as B-B is from A-A. These planes may be used to define the relative location of air knife 60 (not shown). For example, nozzle 90 (not shown) may be located between planes A-A and B-B, directed such that it flows air through plane B-B. In such an embodiment, nozzle 90 may be directed orthogonally—or in a 90-degree relation—to plane B-B. Alternatively, nozzle 90 may be directed at an angle of 45 degrees to plane B-B. Nozzle 90 may be direct at any angle between 45 and 90 degrees to plane B-B in order to most efficiently accomplish the goals explained above, although angles of less than 45 degree or more than 90 degrees may also be used. In another embodiment, nozzle 90 may be located above plane B-B and directed such that it flows air in a direction that does not intersect any of planes A-A, B-B, or C-C.

FIG. 5 also provides a frame of reference for the movement of the pick-up point of the paper product 30 against the roll 20. In one embodiment, if the pick-up point originates in the plane A-A at the point where the paper product 30 contacts roll 20, then the low pressure created by the air knife 60 would cause the sheet pick up point to move out of plane A-A, toward plane B-B.

It should be noted that the methods and systems described herein should not be limited to the examples provided. Rather, the examples are only representative in nature.

Additionally, other embodiments will be apparent from consideration of the specification and practice of the present disclosure. It is intended that the specification and examples be considered as exemplary only, with a true scope and spirit of the invention being indicated by the following claims.

What is claimed is:

1. A method of rolling a paper product onto a roll, comprising:

rotating the roll in a manner that draws the paper product toward the roll and rolls the paper product onto the roll; and altering the location of a pick-up point between the roll and the paper product by influencing the air pressure experienced by the paper product by applying gas in a direction away from the paper product and the roll, wherein the pick-up point is the location where a point on the paper product first contacts the roll.

2. The method of claim 1, wherein gas is applied such that it prevents the paper product from folding as the paper product engages the roll.

3. A method for rolling a paper product onto a roll without creating roll defects, comprising:

suspending the paper product between the roll and a papermaking component;

applying a pressure difference to a portion of the suspended paper product by flowing air in a direction away from the suspended paper product that causes the portion to move toward the roll;

wherein the direction is away from both a pick-up point and the roll associated with the pick-up point, wherein the pick-up point is the location where a point on the paper product first contacts the roll; and rolling the paper product onto the roll.

4. The method of claim 3, wherein applying the pressure difference increases the tension in the portion of the suspended paper product.

5. The method of claim 3, wherein the papermaking component comprises a slitter.

6. The method of claim 3, wherein the papermaking component comprises a second roll.

7. The method of claim 3, wherein the air is flowed in a direction orthogonal to the surface of the portion of the suspended paper product.

8. The method of claim 3, wherein the air is flowed in a direction away from the pick-up point and at a vector angle less than 90 degrees and greater than 45 degrees to a plane of the portion of the suspended paper product.

9. The method of claim 3, wherein the air is directed at a velocity sufficient to prevent the paper product from folding as the paper product engages the roll.

10. The method of claim 3, wherein the air is directed at a volume sufficient to prevent the paper product from folding as the paper product engages the roll.

11. A paper-product rolling apparatus, comprising:

a web;

a roll configured to receive the web at a pick-up point and roll the web onto the roll, wherein the pick-up point is the location where a point on the web first contacts the roll;

a portion of the web located between the roll and a sequentially last papermaking component preceding the roll, and an air knife configured to direct gas away from the roll and the entire portion of the web located between the roll and the sequentially last papermaking component preceding the roll, wherein the gas causes the portion of the web located between the roll and the sequentially last papermaking component preceding the roll to move toward the roll.

12. The apparatus of claim 11, wherein the gas causes the portion of the web to move closer to a point on the surface of the roll that is closest to the portion of the web.

13. The apparatus of claim 11, wherein the portion of the web closest to the air knife is suspended.

14. The apparatus of claim 11, wherein the air knife is directed in a direction substantially orthogonal to the portion of the web that is not yet in contact with the roll.

15. The apparatus of claim 11, wherein the air knife is directed at a vector angle less than 90 degrees and greater than 45 degrees to a plane of the portion of the web that is not yet in contact with the roll.

16. The apparatus of claim 11, wherein the air knife is configured such that it biases the web close to a rotational axis of the roll.

17. The apparatus of claim 11, wherein the air knife is configured such that it prevents the web from folding as it engages the roll.

18. The method of claim 1, wherein the gas is applied in a direction away from a portion of the paper product that is not yet in contact with the roll.

19. The method of claim 3, wherein the air is applied in a direction away from the portion of the suspended paper product.

20. The method of claim 1, wherein the gas is directed in a direction substantially orthogonal to a portion of the paper product that is not yet in contact with the roll.

21. The method of claim 1, wherein the gas is directed at a vector angle less than 90 degrees and greater than 45 degrees to a plane of a portion of the paper product that is not yet in contact with the roll.

* * * * *